US006037959A

United States Patent [19]

Fassler et al.

[11] Patent Number: 6,037,959

[45] Date of Patent: Mar. 14, 2000

[54] SYNCHRONIOUS RE-INKING OF A RE-INKABLE BELT

[75] Inventors: Werner Fassler, Rochester; Charles D. DeBoer, Palmyra; James E. Pickering, Holcomb, all of N.Y.

[73] Assignee: Eastman Kodak Company, Rochester, N.Y.

[21] Appl. No.: 09/134,970

[22] Filed: Aug. 17, 1998

[51] Int. Cl.[7] ..... B41J 31/14; B41J 31/16

[52] U.S. Cl. ..... 347/171; 400/202.4; 400/198

[58] Field of Search ..... 347/171; 400/197, 400/198, 200, 201, 202, 202.2, 202.4

[56] References Cited

U.S. PATENT DOCUMENTS

| | | | |
|---|---|---|---|
| 4,661,393 | 4/1987 | Uchiyama et al. . | |
| 5,043,318 | 8/1991 | Kawakami et al. . | |
| 5,118,657 | 6/1992 | Kawakami et al. . | |
| 5,137,382 | 8/1992 | Miyajima . | |
| 5,286,521 | 2/1994 | Matsuda et al. . | |
| 5,334,574 | 8/1994 | Matsuda et al. . | |
| 5,611,847 | 3/1997 | Guistina et al. . | |
| 5,679,139 | 10/1997 | McInerney et al. . | |
| 5,679,141 | 10/1997 | McInerney et al. . | |
| 5,679,142 | 10/1997 | McInerney et al. . | |
| 5,692,844 | 12/1997 | Harrison et al. | 400/202.4 |
| 5,698,018 | 12/1997 | Bishop et al. . | |

OTHER PUBLICATIONS

Venkataraman, The Chemistry of Synthetic Dyes; Academic Press, 1970: vols. 1–4.

Pigment Handbook; Lewis, P. A., Ed.; Wiley, New York, 1988.

The Colour Index Society of Dyes and Colourists, Yorkshire, England, vols. 1–8.

*Primary Examiner*—Huan Tran

*Attorney, Agent, or Firm*—Raymond L. Owens

[57] ABSTRACT

Apparatus for replenishing dye from a re-inkable belt after such apparatus has transferred dye to form an image in response to image signals on a moveable receiver includes a re-inkable belt moveable along an endless path and having a plurality of separated ink patches each one being adapted to receive and transfer a different colorant and a re-inking turret having a plurality of rollers each one of has different transferable colorant and corresponds to a particular ink patch. The receiver is moved into proximate contact with the ink patches at a nip position. The apparatus responds to the image signals for applying energy to the re-inkable belt at the nip position to imagewise transfer colorant from the re-inkable belt to the receiver depleting colorant in an imagewise pattern and imagewise replenishment of depleted colorant on the ink patches of the ink belt to transfer colorant into the ink transfer surface includes a structure responsive to the image signals and the position of the re-inkable belt to cause particular rollers to engage corresponding moving ink patches at an ink transfer position for transferring ink to such patches such that the transfer of colorant from each roller to the corresponding patches is in synchronization with the movement of the re-inkable belt.

2 Claims, 3 Drawing Sheets

SYNCHRONIOUS RE-INKING OF A RE-INKABLE BELT

CROSS REFERENCE TO RELATED APPLICATIONS

Reference is made to commonly assigned U.S. patent application Ser. No. 09/058,016 filed Apr. 9, 1998 entitled "Using Laser Light for Thermal Color Printing on a Moveable Receiver" to Werner Fassler et al. The disclosure of this related application is incorporated herein by reference.

FIELD OF THE INVENTION

This invention relates to an apparatus for thermal printing with a re-inkable belt where the re-inking mechanism is synchronized with the belt printing movement.

BACKGROUND OF THE INVENTION

Color transfer thermal printers use a color donor member which may be a sheet, but usually is in the form of a web advanced from a supply roll to a take-up roll. The color donor member passes between a printhead and a dye receiver member. The thermal printhead comprises a linear array of resistive heat elements. In operation, the resistive heat elements of the printhead are selectively energized in accordance with data from a printhead control circuit. As a result, the image defined by the data from the printhead control circuit is placed on the receiver member.

A significant problem in this technology is that the color donor members used to make the thermal prints are generally intended for single (one time) use. Thus, although the member has at least three times the area of the final print and contains enough colorant to make a solid black image, only a small fraction of the color is ever used.

After printing an image, the color donor cannot be easily reused, although this has been the subject of several patents. The primary reason that inhibits reuse of the color donor is that the color transfer process is very sensitive to the concentration of the colorant in the donor layer. During the first printing operation, color is selectively removed from the layer thus altering its concentration. In subsequent printings, regions of the donor which had been previously imaged have a lower transfer efficiency than regions which were not imaged. This results in a ghost image appearing in subsequent prints.

The cost associated with having a single use donor ribbon is large because of the large area of ribbon required, as well as the large excess of colorant coated on the donor member. While this technology is able to produce high quality continuous tone prints, it is desired to provide an approach which has all of the good attributes of thermal color transfer imaging but without the limitations associated with single use donor members.

Some work has been done by others to accomplish similar goals. For example, U.S. Pat No. 5,286,521 discusses a reusable wax transfer ink donor ribbon. This process is intended to provide a dye donor ribbon that may be used to print more than one page before the ribbon is completely consumed. U.S. Pat. No. 4,661,393 describes a reusable ink ribbon, again for wax transfer printing. U.S. Pat No. 5,137,382 discloses a printer device capable of re-inking a thermal transfer ribbon. However, again the technology is wax transfer rather than dye transfer. In the device, solid wax is melted and transferred using a roller onto the reusable transfer ribbon.

U.S. Pat No. 5,334,574 describes a reusable dye donor ribbon for thermal dye transfer printing. This reusable ribbon has multiple layers containing dye which limit the diffusion of dye out of the donor sheet. This enables the ribbon to be used to make multiple prints. In addition, the ribbon may be run at a slower speed than the dye receiver sheet, enabling additional utilization. U.S. Pat No. 5,118,657 describes a multiple use thermal dye transfer ink ribbon. This ribbon has a high concentration dye layer on the bottom and low concentration dye layer on the top. The low concentration dye layer meters or controls dye transfer out of the ribbon. This enables the ribbon to be used multiple times. U.S. Pat No. 5,043,318 is another example of a thermal dye transfer ribbon which can be used multiple times.

Another problem with the resistive head thermal printers described above is high the large amount of energy used by thermal resistive printing. This is because the heat generated by resistive printing head must first heat the support layer before the heat reaches the color donor layer. While the color donor layer can be quite thin and therefore have a low heat capacity, the support layer must be relatively thick, particularly if the support is to be used for multiple printing events without tearing or distorting from the insult of the printing operation.

SUMMARY OF THE INVENTION

An object of this invention is to provide a method and apparatus for printing high quality color images at low cost.

These objects are achieved by apparatus for replenishing dye from a re-inkable belt after such apparatus has transferred dye to form an image in response to image signals on a moveable receiver comprising:

a) a re-inkable belt moveable along an endless path and having a plurality of separated ink patches each one being adapted to receive and transfer a different colorant;

b) a re-inking turret having a plurality of rollers each one of has different transferable colorant and corresponds to a particular ink patch;

c) means for causing the moveable receiver to move into proximate contact with the ink patches at a nip position;

d) means responsive to the image signals for applying energy to the re-inkable belt at the nip position to imagewise transfer colorant from the re-inkable belt to the receiver depleting colorant in an imagewise pattern; and e) means for imagewise replenishing depleted colorant on the ink patches of the ink belt to transfer colorant into the ink transfer surface including means responsive to the image signals and the position of the re-inkable belt to cause particular rollers to engage corresponding moving ink patches at an ink transfer position for transferring ink to such patches such that the transfer of colorant from each roller to the corresponding patches is in synchronization with the movement of the re-inkable belt.

Advantages

An advantage of this invention is that a single position of the belt is used for re-inking and duplication of re-ink stations can be avoided Another advantage of this invention is that the re-inkable belt can be moved at the same rate as printing because a suitable section of the re ink roller is engagement for diffusion to refill a completely colorant depleted area in the same allotted time as the printing speed. To achieve all the objectives of re-inking at print speed by synchronizing the re ink roller engagement to the beginning and end of each color patch the same amount of diffusion exposure is achieved. This prevents non-uniform deposition of colorant, and the printing speed is the determination of belt speed.

Another advantage of this invention is that the apparatus can be made smaller because the re-ink station occupies less space.

A feature of this invention is that the images are inexpensive because there is no wasted belt material and colorant.

DETAILED DESCRIPTION OF THE INVENTION

Figure 1:
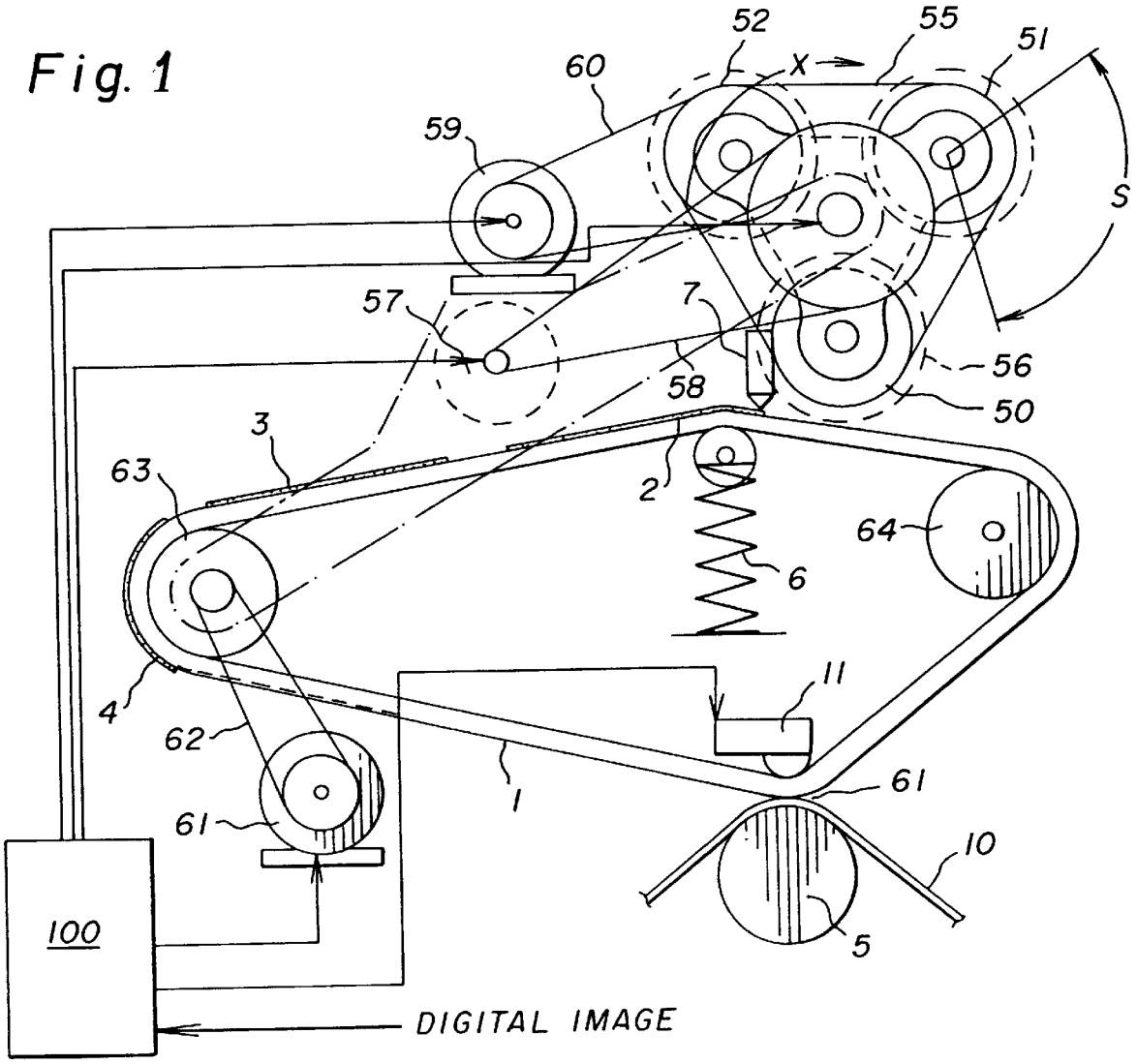
FIG. 1 shows a printer with the re-inkable belt and the re-inking stations in the off position.

FIG. 1 shows the apparatus of the present invention. Cyan, magenta, and yellow re-inking stations 50, 51, and 52 re-ink the re-inkable belt 1. Re-inking is accomplished through the process of diffusion through the semi-permeable membrane 56. Cyan, magenta, and yellow ink patches 2, 3, and 4 are diffusion generated on the re-inkable belt 1. The re-inking is accomplished by engaging the rollers of the cyan, magenta, and yellow re-inking stations 50, 51, and 52 with the corresponding areas of the re-inkable belt 1. The patch 2, 3, and 4 positions on the belt are sensed by a patch edge sensor 7 to engage the cyan, magenta, and yellow re-inking stations 50, 51, and 52 with the corresponding color patches 2, 3, and 4. The re-inkable belt land the rollers of the cyan, magenta, and yellow re-inking stations 50, 51, and 52 must be in direct contact with a suitable pressure for a long enough time so that ink saturation in the cyan, magenta and yellow ink patches 2, 3, and 4 can take place. A finite wrap angle shown as dimension "s" is used to achieve the contact time needed to diffuse colorant into the cyan, magenta and yellow ink patches 2, 3, and 4. At the nip position a thermal print head 11 heats the re-inkable belt 1 in an imagewise fashion. Transmission of the heat generated by the thermal print head 11 through the re-inkable belt 1 then causes the correct amount of ink to transfer into the moveable receiver 10. A platen roller 5 maintains the contact between the re-inkable belt 1, print head 11, and moveable receiver 10. After image printing the re-inkable belt 1 moves to the re-inking turret 55. Spent ink is replenished by the process of diffusion through a semi-permeable membrane 56. The re-inking turret 55 contains a separate ink roller for each color. A preferred number of three cyan, magenta, and yellow re-inking stations 50, 51, and 52 are shown to account for the three colors needed to achieve a "full color" image. A re-inking station index actuator 57, with a re-inking station index drive belt 58 is shown to rotate the correct roller into position for diffusion. Also shown are an electric motor 59, with a drive belt 60 to drive the cyan, magenta, and yellow re-inking station rollers 50, 51, and 52 at the same velocity as the printing speed dictates. A belt tensioning actuator 6 provides the re-inkable belt 1 with tension and also has enough stroke to take up the slack caused by the disengagement of the cyan, magenta, and yellow re-inking station rollers 50, 51, and 52. The re-inkable belt 1 is shown as driven by a re-inkable belt drive motor 61, and an associated drive belt 62. Also shown are two turn-around rollers 63 and 64 for the re-inkable belt 1. The re-ink is move and held by an turret arm shown as 65. A computer 100 provides the signals to operate all of the motors and actuators.

Figure 2:
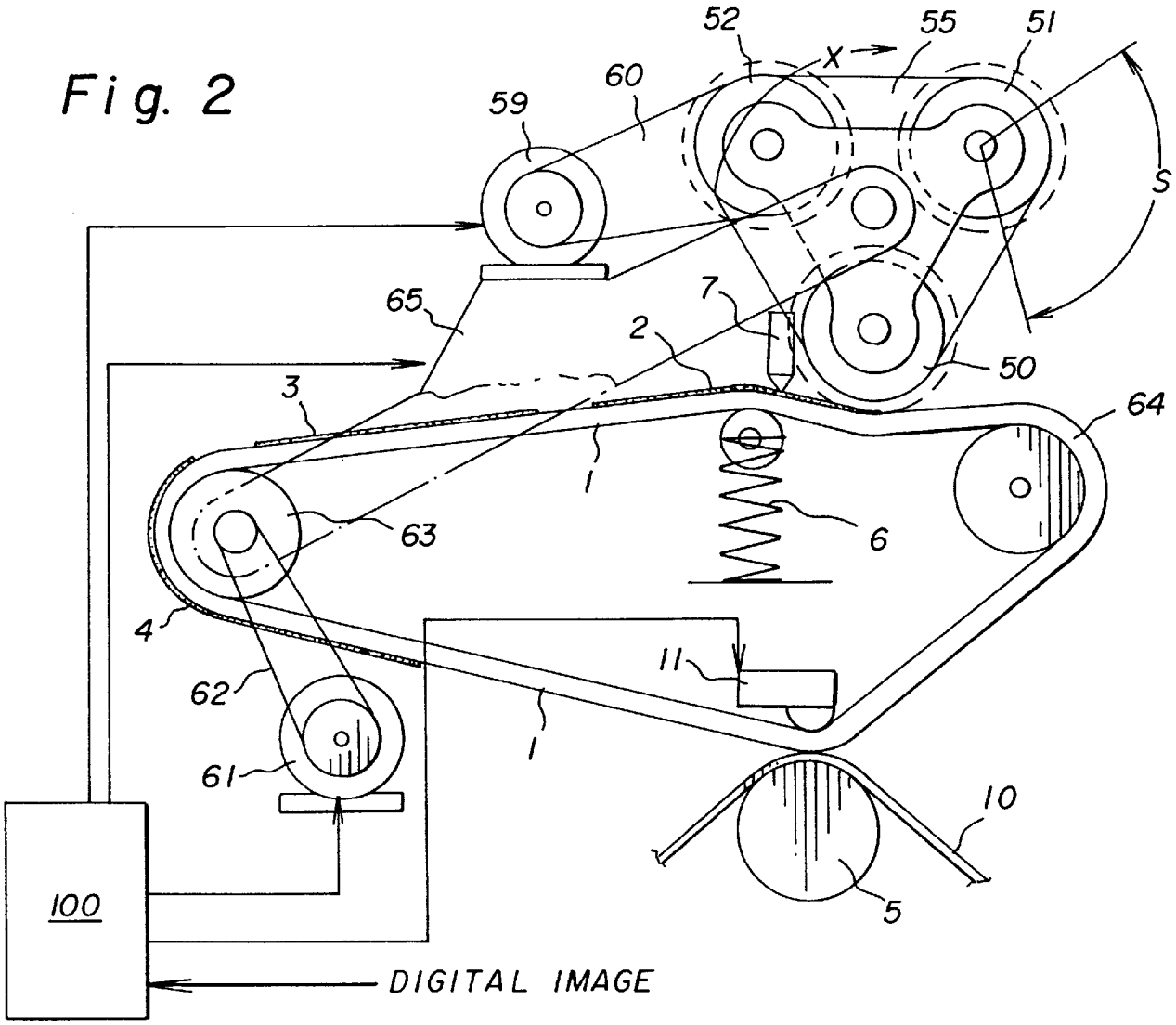
FIG. 2 shows a printer with re-inkable belt and the re-inking stations in the process of engagement.

FIG. 2 shows the turret arm 65 starting a synchronized down stroke to engage the cyan re-inking station 50 roller with cyan ink patch 2. The engagement stroke velocity is coordinated with the cyan re-inking station 50 roller velocity so that wrap angle engagement does not interfere with the equal surface speed of the roller and the re-inkable belt 1. The down drive turret arm 65 velocity impacts the re-inkable belt 1 as a driving force and causes speed and pressure variations in diffusion which result in image non-uniformity's. By adjusting, and synchronizing the cyan, magenta, and yellow re-inking stations 50, 51, and 52 roller speeds and the engagement speed the speed and pressure variations are eliminated. And the diffusion exposure time is the same from beginning to the end of the colorant patch. All of the actuators are timed and controlled by a computer 100.

Figure 3:
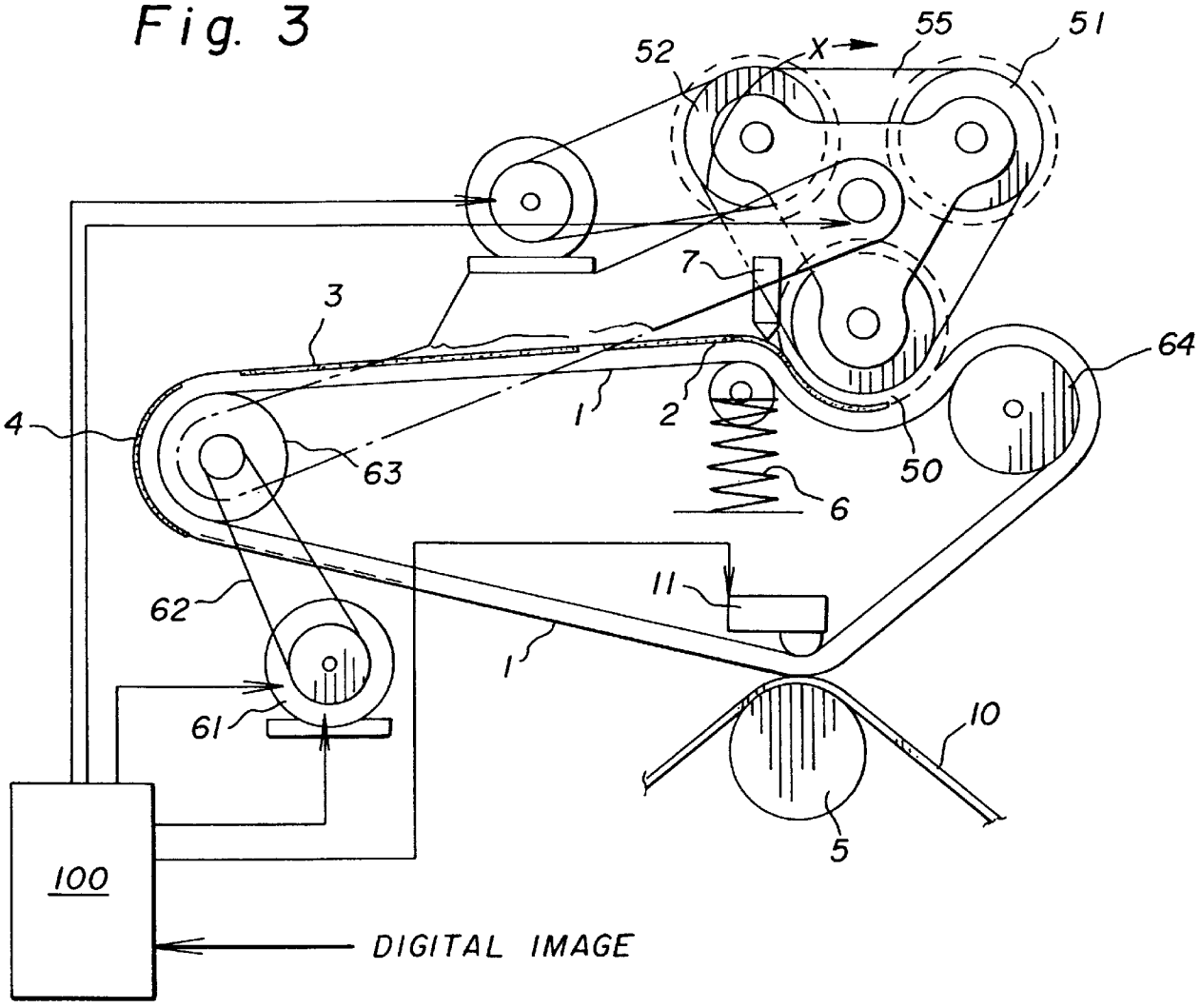
FIG. 3 shows a printer with re-inkable belt and the re-inking stations in the fully engaged position.

FIG. 3 shows the cyan re-inking station roller 50 fully engaged with the re-inkable belt 1. Dye diffusion takes place during the contact. As the end of the cyan ink patch 2 approaches a synchronized removal of the re-ink roller 50 is initiated by the edge sensor 7. And after re inking the roller 50 of the re-inking turret 55 is in a non-contact position for turret 55 rotation to select the correct color before the next ink patch 3 arrives at the re-inking turret 55.

Full details of the re-inking stations and their operation is to be found in U.S. Pat. No. 5,692,844 to Daniel J. Harrison et al.

The inks used in this invention may be dispersions of pigments in common solvents, or solutions of dyes in such solvents. The liquid colorants that feed the cyan, magenta, and yellow re-inking stations 50, 51, and 52 of this invention are commonly called inks, colorants, or dyes by those skilled in the art. Examples of such inks may be found in U.S. Pat. No. 5,611,847 by Gustina, Santilli and Bugner. Inks may also be found in the following commonly assigned U.S. Pat. Nos. 5,679,139; 5,679,141; 5,679,142; 5,698,018; and U.S. Ser. No. 09/034,676 filed Mar. 4, 1998 entitled "Pigmented Inket Inks Containing Phosphated Ester Derivatives" by Martin. In a preferred embodiment of the invention the solvent is water. Colorants such as the Ciba Geigy Unisperse Rubine 4BA-PA, Unisperse Yellow RT-PA, and Unisperse Blue GT-PA are also preferred embodiments of the invention. Preferred examples of dyes used to make solution inks include those listed in Venkataraman, The Chemistry of Synthetic Dyes; Academic Press, 1970: Vols. 1–4 and The Colour Index Society of Dyes and Colourists, Yorkshire, England, Vols. 1–8. Examples of suitable dyes include cyanine dyes (e.g., streptocyanine, merocyanine, and carbocyanine dyes), squarylium dyes, oxonol dyes, anthraquinone dyes, diradical dicationic dyes (e.g., IR165), and polycyclic aromatic hydrocarbon dyes. Similarly, pigments can be included within the thermal mass transfer material to impart color and/or fluorescence. Examples are those known for use in the imaging arts including those listed in the Pigment Handbook; Lewis, P. A., Ed.; Wiley, New York, 1988, or available from commercial sources such as Hilton-Davis, Sun Chemical Co., Aldrich Chemical Co., and the Imperial Chemical Industries, Ltd.

The material chosen for the re-inkable belt 1 of this invention should be durable, flexible, and capable of uniform re-inking by the colorants. Exemplary materials are thin metal belts such as stainless steel, aluminum and titanium. Polymeric materials may also be employed, provided they are resistant to distortion by high temperature localized heating. An exemplary material is the thermoset polyamide resin Kapton, sold by the DuPont Corporation. Polydimethylsiloxane belts are also useful.

The invention has been described in detail, with particular reference to certain preferred embodiments thereof, but it should be understood that variations and modifications can be effected with the spirit and scope of the invention.

PARTS LIST

1 re-inkable belt
2 cyan ink patch
3 magenta ink patch
4 yellow ink patch
5 platen roller
6 belt tensioning actuator
7 edge sensor
10 moveable receiver
11 thermal print head
50 cyan re-inking station
51 magenta re-inking station
52 yellow re-inking station
55 re-inking turret
56 semi-permeable membrane
57 re-inking station index actuator
58 re-inking station index drive belt
59 electric motor for re-inking station
60 drive belt for re-inking station
61 re-inkable belt drive motor
62 drive belt for re-inkable belt
63 re-inkable belt turn-around roller
64 re-inkable belt turn-around roller
65 turret arm
100 computer

What is claimed is:

1. Apparatus for replenishing dye from a re-inkable belt after such apparatus has transferred dye to form an image in response to image signals on a moveable receiver comprising:

a) a re-inkable belt moveable along an endless path and having a plurality of separated ink patches each one being adapted to receive and transfer a different colorant;

b) a re-inking turret having a plurality of rollers each one has different transferable colorant and corresponds to a particular ink patch;

c) means for causing the moveable receiver to move into proximate contact with the ink patches at a nip position;

d) means responsive to the image signals for applying energy to the re-inkable belt at the nip position to imagewise transfer colorant from the re-inkable belt to a receiver depleting colorant in an imagewise pattern; and e) means for imagewise replenishing depicted colorant on the ink patches of the re-inkable belt to transfer colorant onto an ink transfer surface including means responsive to the image signals and the position of the re-inkable belt to cause particular ones of the plurality of rollers to engage corresponding moving ink patches at an ink transfer position for transferring ink to such patches such that the transfer of colorant from each roller to the corresponding patches is in synchronization with the movement of the re-inkable belt.

2. The apparatus set forth in claim 1 further including belt tension actuating means for deflecting the re-inkable belt to cause a portion of the re-inkable belt to wrap around a roller when in an ink transfer position.

* * * * *